US009651909B2

(12) United States Patent
Okada

(10) Patent No.: US 9,651,909 B2
(45) Date of Patent: May 16, 2017

(54) JOB PROCESSING APPARATUS FOR STORING AND EXECUTING RECEIVED JOBS, CONTROL METHOD AND STORAGE MEDIUM THEREOF

(75) Inventor: Hideyuki Okada, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 783 days.

(21) Appl. No.: 12/788,198

(22) Filed: May 26, 2010

(65) Prior Publication Data

US 2010/0302574 A1 Dec. 2, 2010

(30) Foreign Application Priority Data

May 28, 2009 (JP) ..... 2009-128889

(51) Int. Cl.
*G03G 15/00* (2006.01)

(52) U.S. Cl.
CPC ..... *G03G 15/55* (2013.01); *G03G 15/5083* (2013.01); *G03G 2215/00725* (2013.01); *G03G 2215/00772* (2013.01); *G03G 2221/1672* (2013.01)

(58) Field of Classification Search
None
See application file for complete search history.

(56) References Cited

U.S. PATENT DOCUMENTS 4,083,553 A * 4/1978 Beck ..... G03G 15/6502 271/117
6,504,619 B1 * 1/2003 Kageyama et al. ..... 358/1.14
2003/0035672 A1 2/2003 Kidani et al.
2003/0214678 A1* 11/2003 Shibata et al. ..... 358/405
2004/0165209 A1* 8/2004 Aoki et al. ..... 358/1.14
2004/0190057 A1 9/2004 Takahashi
2005/0099647 A1* 5/2005 Aichi ..... 358/1.15
(Continued)

FOREIGN PATENT DOCUMENTS

JP 11-134122 A 5/1999
JP 2000-062292 A 2/2000
(Continued)

*Primary Examiner* — Ming Hon
(74) *Attorney, Agent, or Firm* — Canon USA, Inc. IP Division

(57) ABSTRACT

When it is judged that a predetermined operation for eliminating a cause for stopping a job is being executed, a following job is restricted from being executed prior to a stopped job. A control method for controlling a job processing apparatus for storing received jobs in a storage unit and sequentially executing the stored jobs includes determining, when a cause for stopping the job to be executed is generated, whether a state in which the cause for stopping the job is not eliminated has continued for a predetermined time, executing, when it is determined that the state in which the cause for stopping the job is not eliminated has continued for the predetermined time, a following job that follows the job is executed prior to the job, judging whether a predetermined operation for eliminating the cause for stopping the job is being executed, and restricting, when it is judged that a predetermined operation for eliminating the cause for stopping the job is being executed, the following job is restricted from being executed prior to the job.

9 Claims, 9 Drawing Sheets

(56) References Cited

U.S. PATENT DOCUMENTS

| | | | | |
|---|---|---|---|---|
| 2005/0133980 | A1* | 6/2005 | Koga | 271/97 |
| 2006/0197971 | A1* | 9/2006 | Simpson et al. | 358/1.14 |
| 2007/0206210 | A1* | 9/2007 | Miyazaki et al. | 358/1.14 |
| 2008/0067733 | A1* | 3/2008 | Iwakiri | B42C 1/12 271/145 |
| 2009/0002730 | A1* | 1/2009 | Yamada et al. | 358/1.9 |
| 2009/0244620 | A1 | 10/2009 | Takahashi | |
| 2010/0231963 | A1* | 9/2010 | Oda | G03G 15/5012 358/1.15 |

FOREIGN PATENT DOCUMENTS

| | | | |
|---|---|---|---|
| JP | 2005-301134 | A | 2/2000 |
| JP | 2000-194524 | A | 7/2000 |
| JP | 2002-209035 | A | 7/2002 |
| JP | 2002-248841 | A | 9/2002 |
| JP | 2004-310746 | | 11/2004 |
| JP | 2007-226057 | A | 9/2007 |
| JP | 2007-232908 | A | 9/2007 |
| JP | 2008-188775 | A | 8/2008 |
| JP | 2010-277311 | A | 12/2010 |

* cited by examiner

JOB PROCESSING APPARATUS FOR STORING AND EXECUTING RECEIVED JOBS, CONTROL METHOD AND STORAGE MEDIUM THEREOF

BACKGROUND OF THE INVENTION

Field of the Invention

The present invention relates to a job processing apparatus, a control method thereof, and a storage medium.

Description of the Related Art

As an example of a conventional job processing apparatus, a print on demand (POD) printing system using an image forming apparatus of an electro-photographic type and an image forming apparatus of an ink jet type is discussed in Japanese Patent Application Laid-Open No. 2004-310746. In such a printing system, when a printing operation set by a printing job cannot be executed due to some causes, the printing operation is stopped, and thereby the system itself is stopped, which causes a longer down time.

Thus, even if a job is stopped due to some causes, if only another job can be executed, firstly, the stopped job is set to a suspended state (saved state). Subsequently, of following jobs of the stopped job, an executable job is executed to continue the printing operation. This function is discussed as a promotion function.

In the printing system including the promotion function, when there is a job that is stopped processing due to some causes, if a predetermined time (time-out period) has elapsed without eliminating the cause for stopping/suspending, the job is set to the suspended state and a following job thereof is executed. As described above, by executing the subsequent job, productivity may be improved.

However, even when an operator wants to eliminate the factor of the stop/suspension, the time-out period can elapse before the printing system actually resumes the printing operation. In that case, even when an operator intends to resume the saved job, the executable job in the following jobs may be executed. For example, if the job is stopped because of run-out of paper, firstly when the job is stopped, counting of the time-out period for setting the job to the suspended state is started.

However, even while the operator is supplying the sheets, since the counting is not stopped, the time-out period has been elapsed during a sheet supply operation. Thus, the job can be moved to the suspended state. Further, even while the sheet feeding deck is lifting up the supplied sheets, or a sheet blowing function built in the sheet feeding device for, for example, blowing the sheets with air or adjusting a temperature by a dehumidification heater is being operated, the counting is not stopped. Therefore, of following jobs of a current job, an executable job can be executed.

SUMMARY OF THE INVENTION

According to an aspect of the present invention, a job processing apparatus for storing received jobs in a storage unit and sequentially executing the stored jobs, the job processing apparatus includes a determining unit configured to determine, when a cause for stopping a job to be executed is generated, whether a state in which the cause for stopping the job is not eliminated has continued for a predetermined time, a job execution unit configured to execute, when the determining unit determines that the state in which the cause for stopping the job is not eliminated has continued for the predetermined time, a following job that follows the job is executed prior to the job, a judgment unit configured to judge whether a predetermined operation for eliminating the cause for stopping the job is being executed, and a control unit configured to restrict, when the judgment unit judges that a predetermined operation for eliminating the cause for stopping the job is being executed, the job execution unit restrict the executing of the following job prior to the job.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

Figure 1:
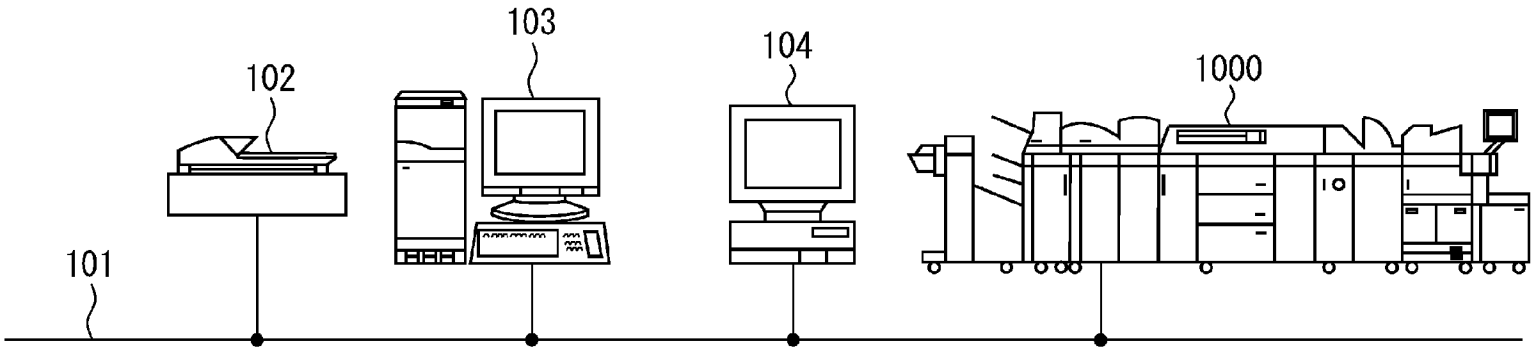
FIG. 1 illustrates an example of a POD system to which a printing system is applied.

FIG. 1 illustrates a POD system to which a printing system, which is an example of a job processing system according to the present exemplary embodiment, is applied. The present exemplary embodiment includes a printing system 1000, a scanner 102, a server computer 103 (personal computer (PC) 103), and a client computer 104 (PC104), which are connected to each other via a network 101.

In FIG. 1, the PC 103 manages data and receives/transmits the data from/to various apparatuses connected to the network 101. The PC 104 transmits image data to the printing system 1000 and the PC 103 via the network 101. The printing system 1000 prints the received image data, transmits the received data to other devices, or stores the received data in a storage device.

Figure 2:
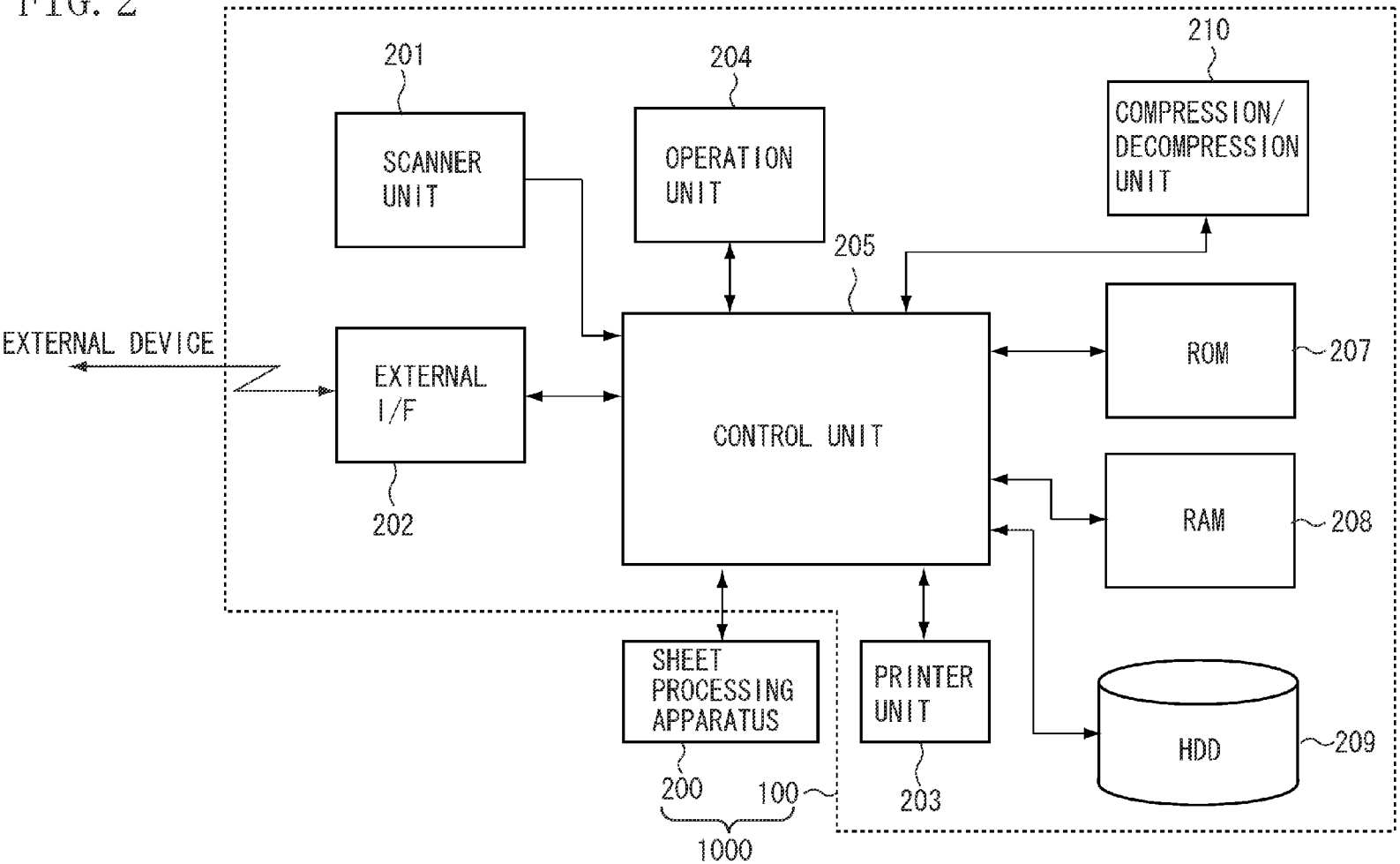
FIG. 2 is a block diagram illustrating a configuration of the printing system.

As illustrated in FIG. 2, the printing system 1000 according to the present exemplary embodiment includes the image forming apparatus 100 and the sheet processing apparatus 200 that are examples of the job processing apparatus. In the present exemplary embodiment, as an example of the image forming apparatus 100, a multifunction peripheral (MFP) having a plurality of functions such as a copying function and a printing function will be described.

However, the image forming apparatus 100 may be the image forming apparatus of a single function type having only the copying function or the printing function.

Next, a configuration of the printing system 1000 will be described with reference to a block diagram of a system as illustrated in FIG. 2. Apart from the sheet processing apparatus 200, the image forming apparatus 100 includes units included in the printing system 1000 illustrated in FIG. 2. An arbitrary number of the sheet processing apparatuses 200 can be connected to the image forming apparatus 100.

The printing system 1000 can execute sheet processing on a sheet printed by the image forming apparatus 100 using the sheet processing apparatus 200 connected to the image forming apparatus 100. However, only the image forming apparatus 100 can constitute the printing system 1000 without being connected to the sheet processing apparatus 200. The sheet processing apparatus 200 is constituted communicably with the image forming apparatus 100, and receives an instruction from the image forming apparatus 100 to execute the sheet processing as described below.

A scanner unit 201 reads an image on a document. The read image is converted into image data and transferred to another unit. An external I/F 202 receives/transmits the data from/to another device connected to the network 101. A printer unit 203 prints the image onto the sheet based on the input image data.

An operation unit 204 includes a touch panel unit 401 and a key input unit 402 that will be described below referring to FIG. 3, and receives an instruction from a user via the touch panel unit 401 and the key input unit 402. The operation unit 204 performs various displays on the touch panel unit 401 included in the operation unit 204.

A control unit 205 includes a central processing unit (CPU) (not illustrated), and executes programs stored in a read only memory (ROM) 207 and a hard disk drive (HDD) 209. Thus, processing and operations performed by various units included in the printing system 1000 can be comprehensively controlled by the control unit 205. The control unit 205 controls an operation of the image forming apparatus 100 or the sheet processing apparatus 200 connected thereto.

The ROM 207 stores various computer programs to be executed by the control unit 205. For example, the ROM 207 stores programs for enabling the control unit 205 to execute various processing of a flowchart described below and a display control program necessary for displaying various setting screens described below.

Further, the ROM 207 stores a program for enabling the control unit 205 to interpret page description language (PDL) code data received from the PCs 103 and 104, and for executing an operation for rasterizing raster image data. Additionally, the ROM 207 stores a boot sequence and font information. A random access memory (RAM) 208 stores the image data transmitted from the scanner unit 201 and the external I/F 202, various programs loaded from the ROM 207, and setting information.

Further, the RAM 208 stores information about the sheet processing apparatus 200 including the number of the sheet processing apparatus 200 ("0" to "n") connected to the image forming apparatus 100, information about a function of each sheet processing apparatus 200, and an order for connecting the sheet processing apparatuses 200.

The HDD 209 includes a hard disk and a driving unit for reading/writing data therefrom/thereto. The HDD 209 is a storage apparatus having a great capacity for storing the image data that is input from the scanner unit 201 or the external I/F 202 and compressed by the compression/decompression unit 210. The HDD 209 may store the programs for enabling the control unit 205 to execute various processing in the flowcharts described below, and the display control program necessary for displaying the various setting screens.

The control unit 205 can print, via the printer unit 203, the image data stored in the HDD 209 based on the user's instruction. Further, the HDD 209 can be used as a spooler. The control unit 205 manages the image data and the PDL code data received from the PCs 103 and 104 as the job, and stores the image data and the PDL code data in the HDD 209. Furthermore, the control unit 205 can manage the jobs stored in the HDD 209, and obtain the number of the stored jobs and information set for the jobs.

The compression/decompression unit 210 performs a compression/decompression operation on the image data stored in the RAM 208 and the HDD 209 by various compression methods such as Joint Bi-level Image Experts Group (JBIG) and Joint Photographic Experts Group (JPEG).

Figure 3:
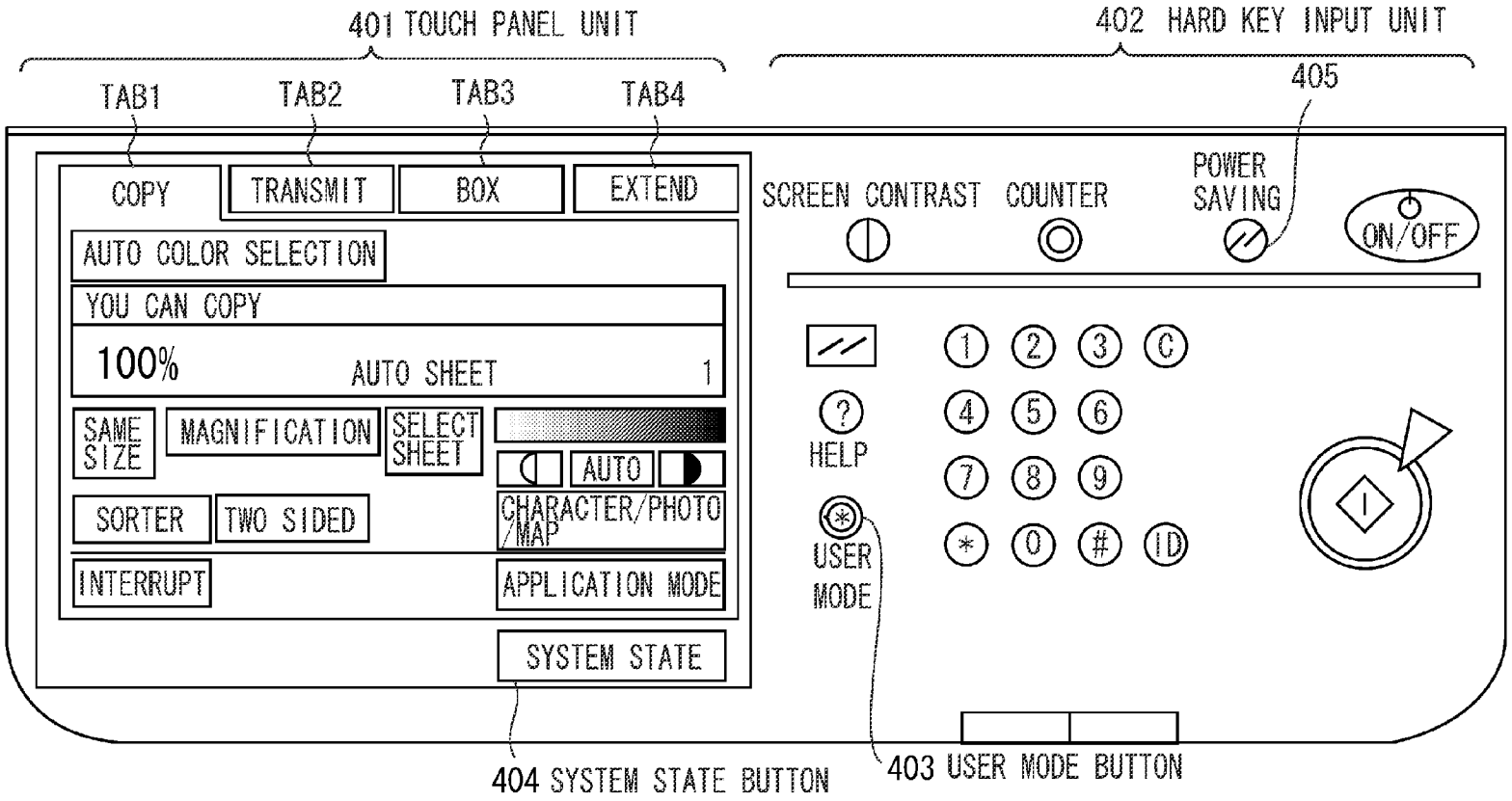
FIG. 3 is a top plan view illustrating a configuration of an operation unit.

FIG. 3 is a top plan view illustrating a configuration of the operation unit 204 illustrated in FIG. 2.

The present exemplary embodiment includes the touch panel unit 401 that is an example of the display unit that can receive the user's operation via a soft key (a display key), and the key input unit 402 that can receive the user's operation via a hard key. The user performs various printing settings using the user interface displayed on the touch panel unit 401. Further, the present exemplary embodiment includes a user mode button 403 and a system state button 404.

In FIG. 3, a power saving state display unit 405 displays that an entire printing system is in a power saving state under a control of the control unit 205. Tab keys TAB1, TAB2, TAB3, and TAB4 are provided corresponding to function settings of "COPY", "TRANSMIT", "BOX", and "EXTEND" respectively.

Figure 4:
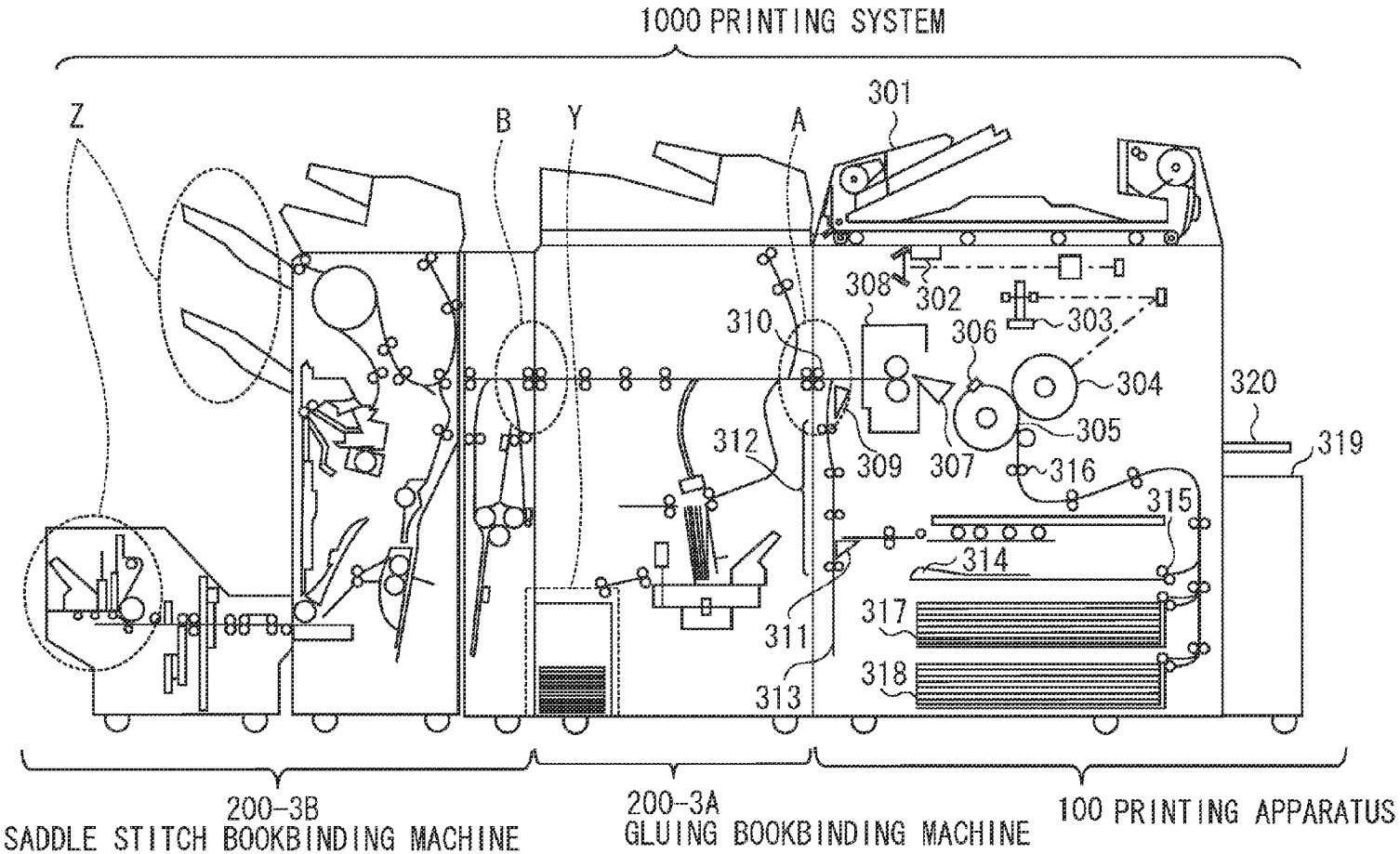
FIG. 4 is a vertical cross-sectional view illustrating configurations of an image forming apparatus and a sheet processing apparatus.

Next, a configuration of the printing system 1000 will be described with reference to FIG. 4. FIG. 4 is a vertical cross-sectional view of a configuration of the image forming apparatus 100 and the sheet processing apparatus 200 connected thereto illustrated in FIG. 1.

In FIG. 4, an auto document feeder (ADF) 301 separates each page of a bundle of documents set on a loading surface of a document tray in an order of page numbers of the documents from the first page. The separated page is fed onto a glass of the document mounting plate to be scanned by the scanner 302.

The scanner 302 reads the image of the document fed onto the glass of the document mounting plate and converts the read image into the image data by a charge coupled device (CCD). A rotating polygon mirror (polygon mirror) 303 allows light beams such as laser beams modulated according to the image data to enter and irradiate onto a photosensitive drum 304 via a reflection mirror as a reflection scanning beam.

A latent image formed by the laser beams on the photosensitive drum 304 is developed with toner, and then a toner image is transferred onto a sheet applied on a transfer drum 305. A series of image forming processing as described above is sequentially executed with respect to the toner of yellow (Y), magenta (M), cyan (C), and black (B) to form a full-color image.

After four-time image forming processing is completed, the sheet applied on the transfer drum 305 on which the full-color image is formed is separated by a separation nail 306, and conveyed to a fixing device 308 by a pre-fixing carrier 307. The fixing device 308 includes rollers and belts, and a built-in power source such as a halogen heater. Thus, the fixing device 308 can melt and fix the toner with heat and pressure on the sheet on which the toner image is transferred.

A sheet discharge flapper 309 is swingably constituted about a swinging axis and regulates a feeding direction of the sheet. When the sheet discharge flapper 309 is swung in a clockwise direction as illustrated in FIG. 4, the sheet is conveyed straight and discharged outside the apparatus by a sheet discharge roller 310. The control unit 205 controls a series of sequence as described above to control the image forming apparatus 100 so that one-sided printing can be executed.

On the other hand, when the image is formed on two sides of the sheet, the sheet discharge flapper 309 swings in a counter-clock wise direction as illustrated in FIG. 4. A direction of the sheet is changed downwardly and conveyed into a two-sided conveyance unit. The two-sided conveyance unit includes a reversing flapper 311 and a two-sided tray 314. The reversing flapper 311 swings about the sliding axis and regulates the conveyance direction of the sheet.

When a two-sided printing job is processed, the control unit 205 swings a reversing flapper 311 in the counter-clockwise direction as illustrated in FIG. 4, and feeds the sheet, on one side of which the printing is performed by the printer unit 203, into a reversing guide 313 via a reversing roller 312.

The control unit 205 once stops the reversing roller 312 with a rear end of the sheet held by the reversing roller 312, and subsequently swings the reversing flapper 311 in the clockwise direction as illustrated in FIG. 4. Further, the control unit 205 rotates the reversing roller 312 in a reverse direction. With this arrangement, the control unit 205 can perform the control so that the sheet is conveyed by switching back, and guided to the two-sided tray 314 with the rear end and a front end of the sheet reversed.

The two-sided tray 314 once loads the sheet, which is subsequently conveyed to a registration roller 316 by a sheet re-feeding roller 315. At this point, the sheet is conveyed with the other face of the first face that is subjected to the transfer processing, facing to a photosensitive dram.

Similar to the processing described above, the second image for the second face is formed on the second face of the sheet. After the image is formed on both sides of the sheet, the sheet is subjected to the fixing processing, and then is discharged from an inside of the image forming apparatus 100 to an outside thereof via the sheet discharge roller 310.

By performing a series of the sequence as described above, the control unit 205 controls the image forming apparatus 100 to execute the two-sided printing. Further, the image forming apparatus 100 includes a sheet feeding unit for storing the sheets to be used for the printing processing. The sheet feeding unit includes a sheet feeding cassettes 317 and 318 capable of storing, for example, 500 sheets each, a sheet feeding deck 319 capable of storing, for example 5,000 sheets, and a manual feed tray 320.

Various types of sheets having different sizes and materials can be separately set in each sheet feeding unit of the sheet feeding cassettes 317 and 318, and the sheet feeding deck 319. Further, various types of sheets including special sheets such as overhead projector (OHP) sheets can be set in the manual feeding tray 320. The sheet feeding cassettes 317 and 318, the sheet feeding deck 319, and the manual feeding tray 320 are each provided with a sheet feeding roller. The sheet feeding roller can continuously feed the sheets one by one.

Next, the sheet processing apparatus 200 including a gluing bookbinding machine 200-3A and a saddle stitch bookbinding machine 200-3B illustrated in FIG. 4 will be described.

As long as the sheet processing apparatus 200 disposed in the printing system 1000 can convey the sheet from an upper-stream apparatus to a down-stream apparatus via a sheet conveyance path, the sheet processing apparatus 200 of an arbitrary type and an arbitrary numbers of the apparatuses can be connected.

For example, as illustrated in FIG. 4, from a side closer to the image forming apparatus 100, the gluing bookbinding machine 200-3A and the saddle stitch bookbinding machine 200-3B are subsequently disposed and connected with each other. The gluing bookbinding machine 200-3A and the saddle stitch bookbinding machine 200-3B can be selectively used in the printing system 1000. Each sheet processing apparatus 200 is provided with a sheet discharge unit. The user can take out the processed sheet from the sheet discharge unit of the sheet processing unit.

The control unit 205 receives an execution request of the sheet processing, whose type is desired by the user and selected from among candidates of the sheet processing executable by the sheet processing apparatus 200 connected to the image forming apparatus 100, together with printing execution request via the operation unit 204. Further, in response to receiving from the user via the operation unit 204 the printing execution request of the job that is target processing, the control unit 205 causes the printer unit 203 to execute the printing processing necessary for the job.

The control unit 205 causes the sheet on which the printing processing is executed to be conveyed to the sheet processing apparatus by which the sheet processing desired by the user can be executed via the sheet feeding path, so that the sheet processing apparatus executes the sheet processing.

For example, when the printing system 1000 has a system configuration illustrated in FIG. 4, the processing target job that receives the printing execution request from the user is instructed to perform the sheet processing by the gluing bookbinding machine 200-3A. For example, the gluing binding processing includes case binding processing and top-gluing binding processing. This job is referred to as a "gluing binding job".

When this gluing binding job is processed by the system configuration illustrated in FIG. 4, the control unit 205 feeds the sheet printed by the image forming apparatus 100 to an inside of the gluing bookbinding machine 200-3A via a point "A" illustrated in FIG. 4. Subsequently, the control unit 205 causes the gluing bookbinding machine 200-3A to execute the gluing binding processing of this job.

The control unit 205 does not feed printings of the job on which the gluing binding processing is performed by the gluing bookbinding machine 200-3A to another apparatus such as an apparatus in a latter stage. Instead, the control unit 205 retains the printings in a sheet discharge destination "Y" inside the gluing bookbinding machine 200-3A. Further, for example, the processing target job that receives the printing execution request from the user in the system configuration illustrated in FIG. 4 is a job that is instructed to be subjected to the sheet processing by the saddle stitch bookbinding machine 200-3B.

The sheet processing performed by the saddle stitch bookbinding machine 200-3B includes, for example, the saddle stitch bookbinding, punching processing, cutting processing, shift discharge processing, folding processing, and stapling processing. In the present exemplary embodiment, this job is referred to as a "saddle stitch bookbinding job".

When the saddle stitch bookbinding job is performed by the system configuration illustrated in FIG. 4, the control unit 205 causes the sheet of the job printed by the image forming apparatus 100 to be carried through the points "A" and "B", and conveys the sheet to the saddle stitch bookbinding machine 200-3B. Subsequently, the control unit 205 causes the saddle stitch bookbinding machine 200-3B to execute the sheet processing of the job. The control unit 205 retains the printings of the saddle stitch bookbinding job on which the sheet processing is performed by the saddle stitch bookbinding machine 200-3B in the sheet discharge destination "Z" thereof.

The sheet discharge destination "Z" has a plurality of candidates of the sheet discharge destinations. This is because the saddle stitch bookbinding machine 200-3B can perform a plurality of types of the sheet processing, and thus the sheet discharge destinations are separated for each sheet processing. In the printing system 1000 of the present exemplary embodiment, a plurality of the sheet processing apparatuses can be connected to the image forming apparatus 100.

The plurality of the sheet processing apparatuses can be connected to the image forming apparatus 100 in any combinations. Orders for connecting the plurality of the sheet processing apparatuses can be arbitrarily changed as long as the sheet feeding paths of the apparatuses can be connected with each other. Further, there are a plurality of types of candidates of the sheet processing apparatuses that can be connected to the image forming apparatus 100.

According to the present exemplary embodiment, various types of user interfaces that are provided by the printing system 1000 and constituted responsively, interactively to the operator function as the execution request reception unit described above. For example, the user interfaces include the operation unit 204 and/or the soft key and the hard key provided at the operation unit 204 and/or various user interface screens illustrated in the Figures as examples.

The above-described units are examples and not limited thereto. For example, the job execution request can be also received from an external apparatus different from the printing system 1000. In this case, for example, the user interface provided at an external data generation source such as the scanner 102, the PCs 103 and 104 functions as the execution request reception unit.

Figure 5:
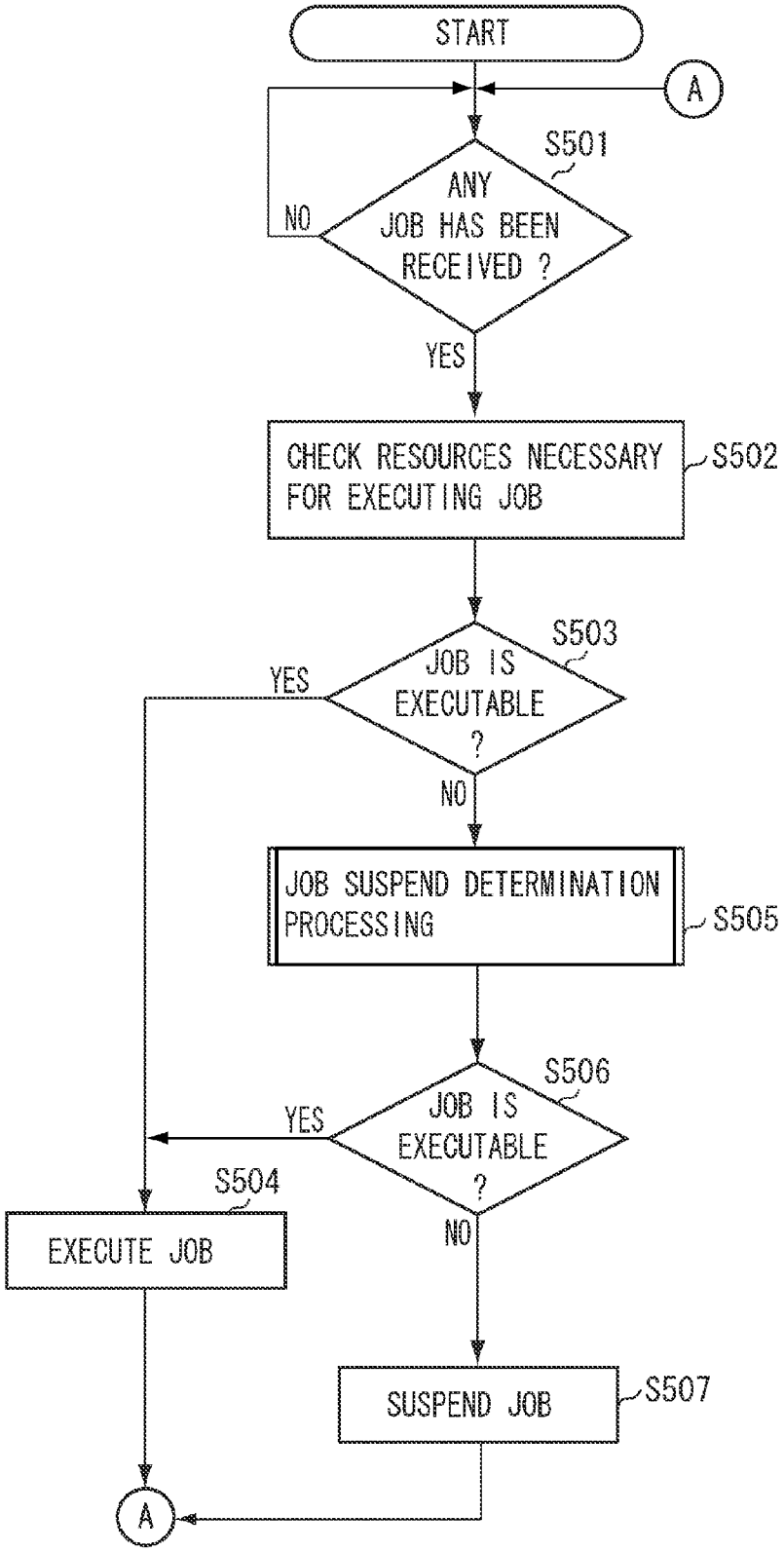
FIG. 5 is a flowchart illustrating a procedure of job control processing performed by the printing system.

FIG. 5 is a flowchart illustrating a procedure of job control processing performed by the printing system according to the present exemplary embodiment. The present exemplary embodiment is executed by the control unit 205. Steps S501, S502, S503, S504, S505, S506, and S507 indicate each step. The control unit 205 loads into the RAM 208 control programs stored in the ROM 207 and the HDD 209, and executes the control programs to realize each step.

Firstly, in step S501, the control unit 205 determines whether a printing job has been received via the external I/F 202 or the operation unit 204. When the control unit 205 determines that the printing job has been received (YES in step S501), the processing proceeds to step S502. In step S502, the control unit 205 checks resources necessary for executing the printing job.

When a stapling setting is set, checks, for example, whether enough needles are set in a stapler included in the saddle stitch bookbinding machine 200-3B, or whether the unit is available is performed. The checking processing is performed by communicating with the control unit (not illustrated) included in the saddle stitch bookbinding machine.

When a preceding job occupies a post processing apparatus, there may be a case where it is determined that the job is not executable.

After the checks are performed on the entire jobs and then similar checks about the post processing are performed on the entire jobs, in step S503, the control unit 205 determines whether the job is executable. When the control unit 205 determines that the job is executable (YES in step S503), the processing proceeds to step S504. As described above, the control unit 205 controls the printing unit and each block, executes the jobs and the post-processing of the printing, and then returns the processing to step S501.

On the other hand, when the control unit 205 determines that the job is not executable (NO in step S503), the processing proceeds to step S505. In step S505, the control unit 205 performs the suspend determination processing on the job that will be described below referring to FIG. 6 in detail. In step S506, the control unit 205 again determines whether the job is executable and further whether the job is to be in the suspended state.

For example, when "job is not to be in suspended state" is set in step S601 described below, the job is ended without setting the job to the suspended state and waits until the cause for stopping the job is eliminated (not illustrated). In this case, since the stopped job is not to be in the suspended state, a following job that follows the job is not executed.

When the job is not set to "job is not to be in suspended state", the processing proceeds to step S506 and the control unit 205 determines whether the job is executable. When the control unit 205 determines that the job is executable (YES in step S506), the processing proceeds to step S504. The control unit 205 executes the printing and the post-processing of the job.

On the other hand, in step S506, when the control unit 205 determines that the job is suspended (NO in step S506), the processing proceeds to step S507. A stopped job is then set to the suspended state in which a saved job is held in the HDD 209. The following job is set to be executable, and the processing returns to step S501. By setting the stopped job to the suspended state, among the following jobs of the job, the executable job is ready to be executed prior to the stopped job.

Figure 6:
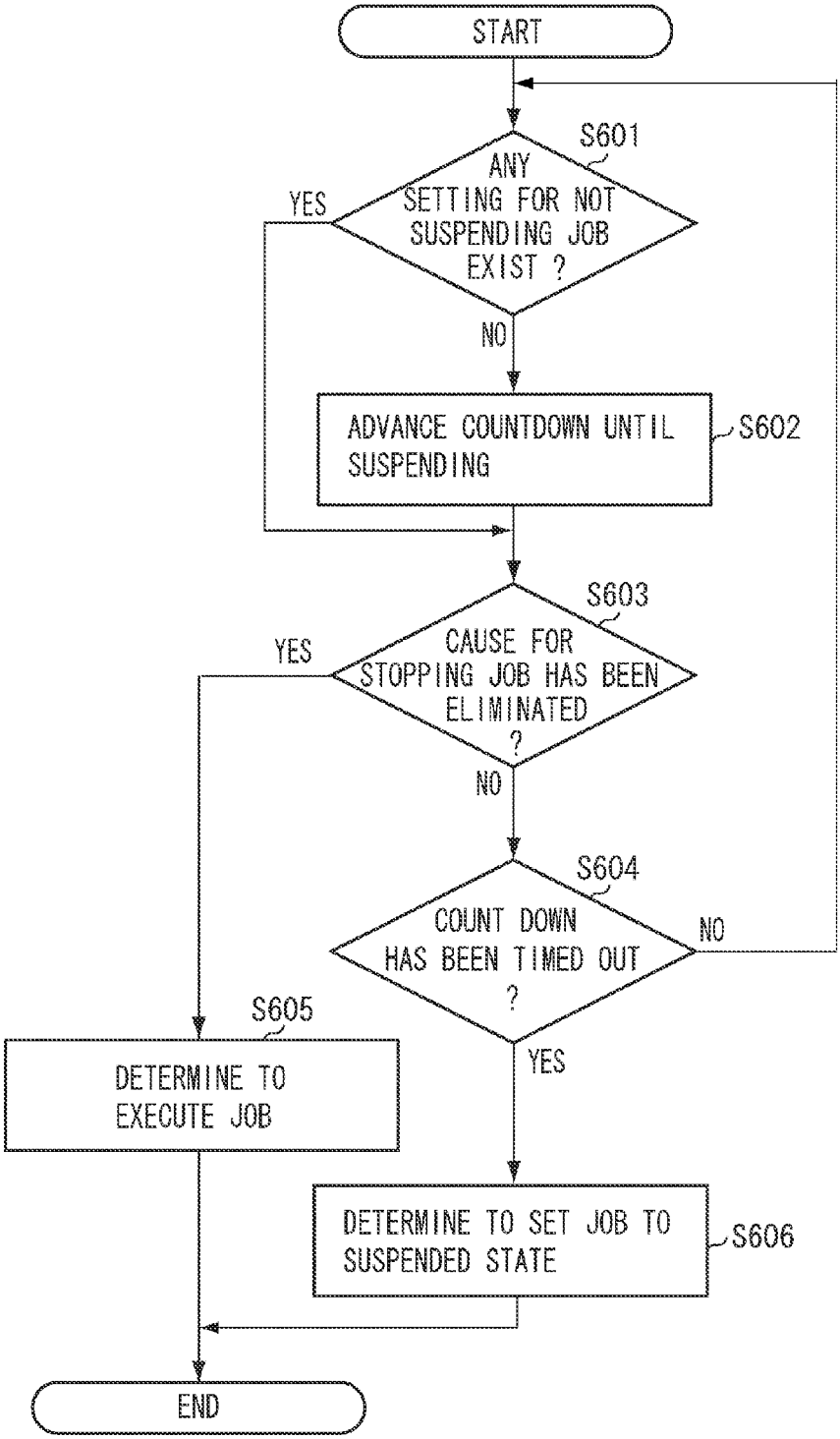
FIG. 6 is a flowchart illustrating a procedure of job control processing performed by the printing system.

FIG. 6 is a flowchart illustrating a procedure of job control processing performed by the printing system according to the present exemplary embodiment.

In the present exemplary embodiment, it is determined whether the job is to be suspended. The control unit 205 loads the control programs stored in the ROM 207 and the HDD 209 into the RAM 208, and executes the programs to realize each step. Further, according to the present exemplary embodiment, before image formation is started, shortage of consumption materials (e.g., sheets) occurs. A case where the image forming processing is stopped due to the shortage of the consumption materials will be described.

Figure 7:
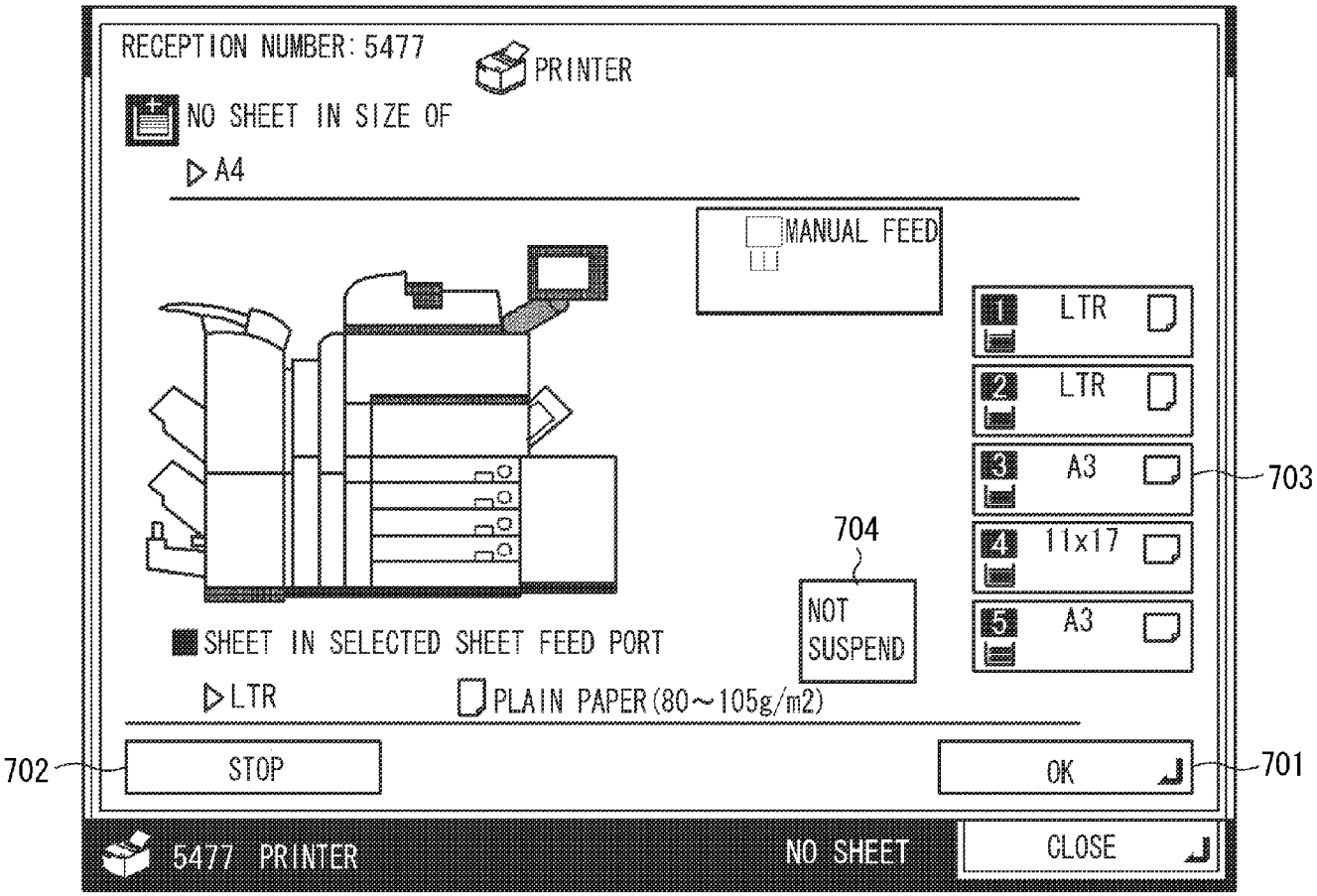
FIG. 7 illustrates an example of a user interface (U/I) displayed on a touch panel unit.

Firstly, in step S503 illustrated in FIG. 5, when it is determined that the job is not executable, the control unit 205 displays a cause by which the job is stopped on a touch panel unit 401 provided at the operation unit 204. FIG. 7 illustrates a more specific example of a display.

FIG. 7 illustrates a user interface displayed on the touch panel unit 401 illustrated in FIG. 3. The present exemplary embodiment describes a case where the sheets to be used for the printing run short. In this case, the control unit 205 performs the display as illustrated in FIG. 7 on the touch panel unit 401, and notifies the user of a shortage of the sheets.

The user can press a stop button 702 to stop the job. Further, with reference to a list 703 of the sheets set in a current sheet feeding stage, the user select the sheet feeding stage and presses an OK button 701 so that the sheets to be used for the job can be changed, and the printing can be started.

Furthermore, the user can press a "not suspend" button 704 for not suspending the job to instruct not to set the job to the suspended state. More specifically, when it is instructed not to set the job to the suspended state, the following job of the stopped job is not executed. On the other hand, when it is not instructed not to set the job to the suspended state, and when a predetermined time has elapse since the job is stopped, the stopped job brought into the suspended state. As a result, the following executable job is performed before the stopped job.

Firstly, in step S601, the control unit 205 determines whether the user presses the "not suspend" button 704 displayed on the touch panel unit 401. When the control unit 205 determines that the user does not press the "not suspend" button 704 (NO in step S601), the processing proceeds to step S602 and advances countdown until the control unit 205 determines that the suspended state is to be set.

On the other hand, in step S601, the control unit 205 determines that the "not suspend" button 704 is pressed (YES in step S601), the job is ended without being set to the suspended state. At this point, the job is set to wait until the cause for stopping the job is eliminated, and is ended (not illustrated). In this case, since the stopped job is not set to the suspended state, the following job of the job is not executed.

In step S603, the control unit 205 determines whether the cause for stopping the job is eliminated. When the control unit 205 determines that the cause for stopping the job is eliminated (YES in step S603), the processing proceeds to step S605. In step S605, the control unit 205 determines that the job is executable and the processing proceeds to step S506 illustrated in FIG. 5. On the other hand, in step S603, when the control unit 205 determines that the cause for stopping the job is not eliminated (NO in step S603), the processing proceeds to step S604.

In step S604, the control unit 205 determines whether the countdown until it is determined that the suspended state is to be set is timed out. When the control unit 205 determines the countdown is timed out (YES in step S604), the processing proceeds to step S606. The control unit 205 then determines that the job is set to be the suspended state, and the processing proceeds to step S506 illustrated in FIG. 5. On the other hand, when the control unit 205 determines that the countdown is not yet timed out, (NO in step S604), the processing in steps S601, S602, S603, and S604 are performed again.

If the processing performed in steps S601, S602, S603, and S604 are set to be performed, for example, once every second, after seconds corresponding to the starting number of the countdown that is previously set have elapsed, the job can be moved into the suspended state.

Further, in the user interface illustrated in FIG. 7, the "not suspend" button 704 may perform toggle display of "suspend/not suspend" every time the "not suspend" button 704 is pressed, so that the job can be a suspend target again.

For example, the "not suspend" button 704 may be constituted as a highlight display button. Only when the display is highlighted, in step S601 illustrated in FIG. 6, the control unit 205 performs processing for determining that a setting not for setting to the suspended state exists. With this control, while the display is highlighted, the job is not set to the suspended state.

As described above, according to the present exemplary embodiment, when the cause for stopping the target job is generated and then the job is stopped, the control unit 205 starts to count a predetermined time. When the predetermined time has been counted, the stopped job is set to the suspended state and saved. Of the following jobs following the saved job, the executable following job is controlled to be executed prior to the saved job. With this control, efficiency for processing the job can be improved.

Further, when the user specifies that the job is not to be saved, even if the predetermined time has been counted, the stopped job is not set to the suspended state, and the following job is not executed prior to the stopped job. More specifically, the specification not for saving the job is also not for executing the following job prior to the stopped job.

Accordingly, for example, if the user who desires to resume the stopped job sets such a specification, while the user is supplying the sheets or the toner, the following job can be prevented from being executed prior to the stopped job.

According to the present exemplary embodiment, when the user specifies not to allow the job to save via the screen illustrated in FIG. 7, a case is described where the following job is controlled not to be executed prior to the stopped job. In addition to such control, the image forming apparatus 100 may execute the control as described in the present exemplary embodiment.

Since the configurations of the system and the apparatus are similar to those in the first exemplary embodiment, the description thereof will not be repeated. Details of operations of the image forming apparatus 100 will be described below.

The image forming apparatus 100 includes a sheet feeding unit for storing the sheets to be used for the printing processing as illustrated in FIG. 4. The sheet feeding unit includes sheet cassettes 317 and 318 capable of storing, for example, 500 sheets each, a sheet feeding deck 319 capable of storing, for example, 5,000 sheets, and a manual feed tray 320.

The sheet feeding cassettes 317 and 318, and the sheet feeding deck 319 can separately store various types of sheets having different sizes and materials in each sheet feeding unit thereof. Further, the manual feeding tray 320 can store therein various types of sheets including specific sheets such as overhead projector (OHP) sheets. The sheet feeding cassettes 317 and 318, the sheet feeding deck 319, and the manual feeding tray 320 are each provided with the sheet feeding roller. The sheet feeding roller can continuously feed the sheets one by one.

Figure 8:
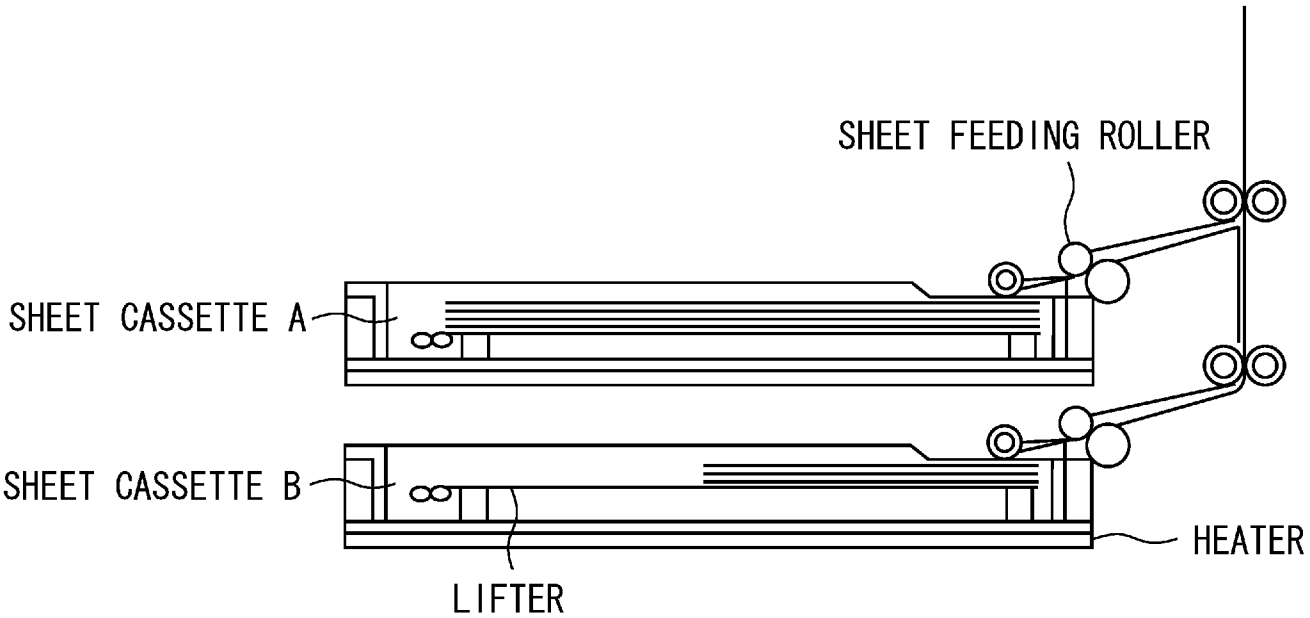
FIG. 8 is a vertical cross-sectional view of main parts illustrating a sheet feeding mechanism in the image forming apparatus.

FIG. 8 is a vertical cross-sectional view illustrating main parts of a sheet feeding mechanism in the image forming apparatus 100 illustrated in FIG. 1.

As illustrated in FIG. 8, the image forming apparatus 100 includes a lifter in the sheet feeding cassette. The sheet is lifted up by the lifter to a height where the sheet can be fed by the sheet feeding roller. Further, for adjusting humidity of the sheet and preventing the sheet from being curled or fed in plurality at a time, a heat unit is provided at each sheet feeding cassette as illustrated in FIG. 8. Furthermore, some image forming apparatuses include a mechanism that prevents the sheets from being fed in plurality at a time by blowing the sheets with the air applied therebetween and thus controlling states between the sheets.

In the image forming apparatus including such a sheet feeding mechanism, for example, if the user feeds the sheets into the sheet feeding cassette of the image forming apparatus, firstly the mechanism starts to lift up the sheets. The mechanism then performs an adjustment of temperature (hereafter, referred to as "temperature adjustment") using the heater. Some apparatuses perform blowing of the sheets with air wind to separate the sheets.

Before a series of the operations described above has not been completed, the image forming apparatus cannot feed the sheets. Therefore, until it can be determined whether the cause for stopping the job can be eliminated, some sheet feeding stages take time more than before. Thus, although the user who desires to resume the stopped job has supplied the sheets, the predetermined time can have elapsed before the user completes a series of operations.

If the sheets are supplied in the sheet feeding stage, resuming the stopped job is preferable, and that is what the user intends rather than executing the following job prior to the stopped job. A control appropriate for such a case will be described as bellow.

Figure 9:
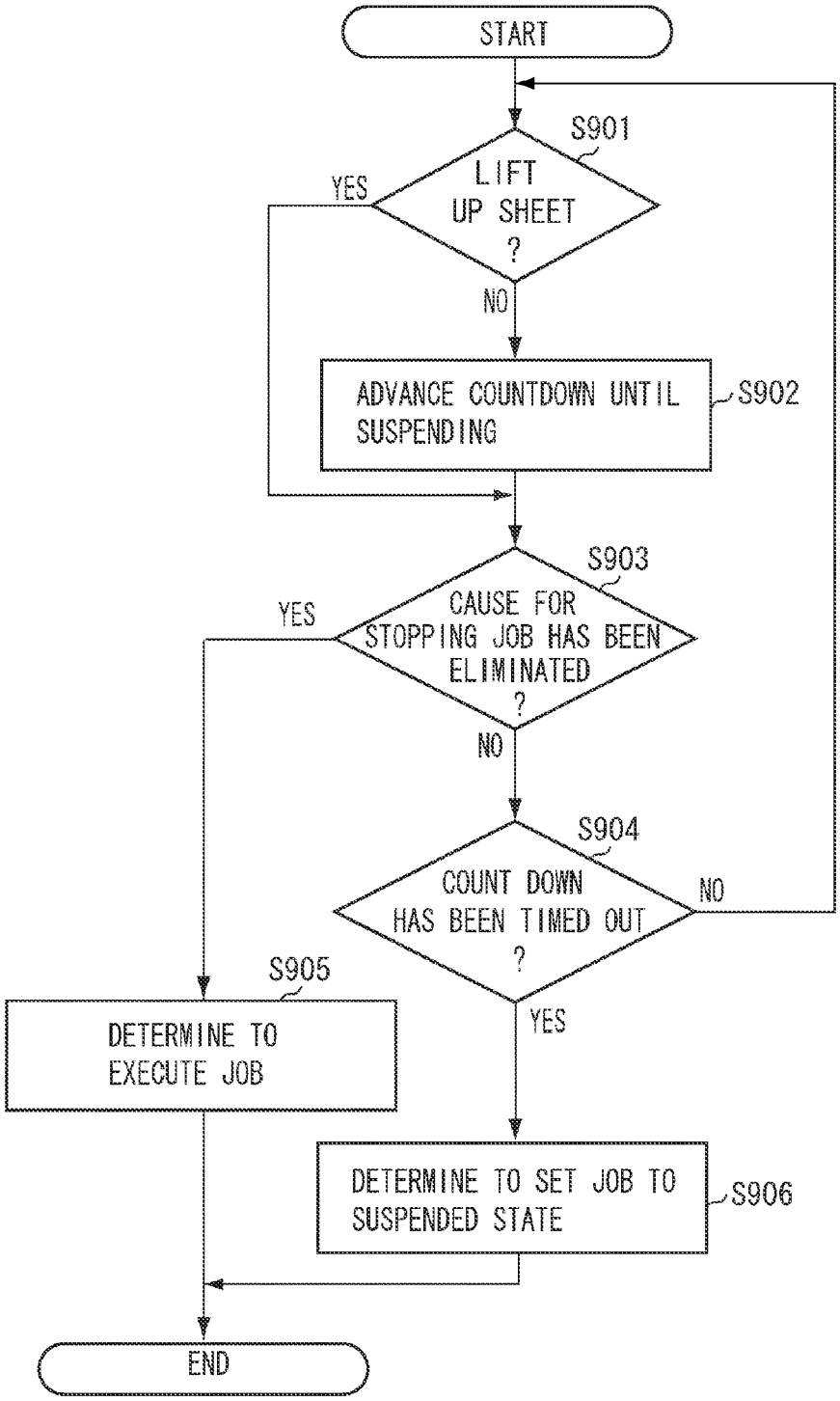
FIG. 9 is a flowchart illustrating a procedure of job control processing performed by the printing system.

FIG. 9 is a flowchart illustrating an example of a procedure of job control processing performed by the printing system 1000 according to the present exemplary embodiment. The control unit 205 loads into the RAM 208 the control programs stored in the ROM 207 and the HDD 209, and executes the control programs to realize each step.

Firstly, in step S901, the control unit 205 determines whether the image forming apparatus 100 performs an operation for eliminating the cause for stopping. More specifically, the control unit 205 determines whether the sheet feeding stage is performing the lift-up operation that is stopped due to the shortage of the sheets. In addition, the control unit 205 may determine whether the heater is performing the temperature adjustment in the sheet feeding stage, or whether the mechanism is performing the operation for stabilizing the separation of the sheets with the air wind in the sheet feeding stage.

The control unit 205 determines the states described above from a sensor provided at the sheets feed stage. In step S901, when the control unit 205 determines that the preparation operations described above are not being executed (NO in step S901), the processing proceeds to step S902. The control unit 205 advances the countdown for the predetermined time until the control unit 205 determines that the job is to be suspended.

On the other hand, in step S901, when the control unit 205 determines that the preparation operation is being executed (YES in step S901), the processing proceeds to step S903 without executing the countdown until suspending. In step S901, when the preparation operation is being executed, the cases described below can be included. More specifically, the cases include cases in which the sheet feeding layer is performing the lift-up operation, the heater is executing the temperature adjustment in the sheet feeding stage, and the mechanism is performing the operation for stabilizing the separation of the sheets with the air wind.

In step S903, the control unit 205 determines whether the cause for stopping the job is eliminated. When the control unit 205 determines that the cause for stopping the job is eliminated (YES in step S903), in step S905, the control unit 205 determines that the job is to be executed. Then, the processing proceeds to step S506 illustrated in FIG. 5.

On the other hand, in step S903, when the control unit 205 determines that the cause for stopping the job is not eliminated (NO in step S903), the processing proceeds to step S904. In step S904, the control unit 205 determines whether the countdown until the control unit 205 determines to set the job to the suspended state is not timed out. When the control unit 205 determines that the countdown is timed out (YES in step S904), the processing proceeds to step S906. The control unit 205 determines that the job is set to the suspended state, and the processing proceeds to step S506 illustrated in FIG. 5.

On the other hand, in step S904, when the control unit 205 determines that the countdown is not timed out (NO in step S904), the processing returns to step S901, and the same processing is performed again. In step S901, when the control unit 205 determines that the preparation operation is being executed (YES in step S901), and in step S904, also determines that the countdown is not timed out (NO in step S904), the countdown is stopped. By stopping the countdown, while the preparation operation is being executed, the stopped job is restricted from being set to the suspended state.

Further, in step S901, when the control unit 205 determines that the preparation operation is being executed, an example is described in which the counter is stopped to count, however, the exemplary embodiment is not limited thereto. When the determined result is positive in step S901, the time for count-up by the counter may be extended longer than that of the case where the preparation operation is not executed in step S901. According to the extended time, in step S901, when the control unit 205 determines that the preparation operation for eliminating the cause for stopping the job is being executed, the control unit 205 restricts the following job from being executed prior to the stopped job.

If the processing of steps S901, S902, S903, and S904 is performed once every one second, after the number of seconds corresponding to the previously set number of starting the countdown have elapsed, the job can be moved into the suspended state.

According to the present exemplary embodiment, when the image forming operation cannot be normally completed and then is stopped, the possibility can be decreased in which it is determined that the cause for stopping the job is not eliminated while a control unique to each sheet feeding stage is performed after the user supplies the sheets.

More specifically, cases are decreased in which, since the predetermined time for stopping the job has elapsed regardless of a user's operation for eliminating the cause for stopping the job, the following job is executed prior to the stopped job. The causes for stopping or suspending the job are described as just examples, and not limited to the causes described above.

For example, when the sheet feeding stage is provided with an opening/closing door, if the door is kept open to supply the sheets, the job can be stopped and then the countdown can be ended. The control unit 205 may inquire of the user about whether the job is to be moved into the suspended state for each sheet feeding unit according to a volume of the sheets that can be fed, so that the job can be controlled according to the user's intension. Further, in step S901, when it is detected that the opening/closing door is opened, the processing may proceeds to step S903 without executing the countdown until suspending.

Furthermore, the consumable materials that is consumed by the image forming apparatus and can be supplied (e.g., the developing materials, the needles of the stapler, and glue materials) may be similarly applied to the determination performed in step S901. Moreover, the printing job is described as an example of an attribute of the target job, however, other attributes, a receiving job, or a scanning job can be similarly controlled.

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., computer-readable medium). In such a case, the system or apparatus, and the recording medium where the program is stored, are included as being within the scope of the present invention.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-128889 filed May 28, 2009, which is hereby incorporated by reference herein in its entirety.

What is claimed is:

1. A printing apparatus for executing a first print job and a second print job following the first print job, comprising:

one or more processors;

one or more memories, wherein one or more programs are stored in the one or more memories and configured to be executed by the one or more processors, the one or more programs including:

instruction for determining whether a state in which the first print job is stopped has continued for a predetermined time;

instruction for whether a preparation operation in which sheets stored in a sheet feeding cassette are moved to a position at which the sheets can be fed is started;

instruction for executing the second job in priority to the stopped first print job if it is determined that the state in which the first print job is stopped has continued for the predetermined time; and instruction for controlling not to determine that the state in which the first print job is stopped has continued for the predetermined time in a case where it is judged that the preparation operation is started before it is determined that the state in which the first print job is stopped has continued for the predetermined time.

2. A printing apparatus according to claim 1, further comprising a lifter configured to lift up the sheet stored in the sheet cassette to the predetermined position.

3. A printing apparatus according to claim 2, wherein the lifter lifts up the sheet stored in the sheet cassette in the preparation operation.

4. A printing apparatus according to claim 1, further comprising a counter configured to count the predetermined time, wherein, in a case where it is judged that the preparation operation is started, the instruction for controlling is an instruction for controlling the counter to stop counting of the predetermined time.

5. A printing apparatus according to claim 1, further comprising a display configure to display a cause for stopping the first job.

6. A printing apparatus according to claim 1, wherein the first print job is stopped due to lack of no sheet in the sheet cassette.

7. A printing apparatus according to claim 1, wherein the preparation operation is executed in accordance with closing door for supplying sheets to the sheet cassette.

8. A control method for controlling a printing apparatus for executing a first printing job and a second printing job following the first print job, the control method comprising:

determining whether a state in which the first print job is stopped has continued for a predetermined time;

judging whether a preparation operation in which sheets stored in a sheet cassette are moved to a predetermined position is started;

executing the second print job in priority to the stopped first print stopped job if it is determined that the state in which the first print job is stopped has continued for the predetermined time; and controlling not to determine that the state in which the first print job is stopped has continued for in a case where it is judged that the preparation operation is started before it is determined that the state in which the first job is stopped has continued for the predetermined time.

9. A non-transitory computer readable storage medium for storing a computer program for controlling a print apparatus for executing a first print job and a second print job following the first job, the computer readable storage medium comprising:

a code to determine whether a state in which the first print job is stopped has continued for a predetermined time;

a code to judge whether a preparation operation in which sheets stored in a sheet cassette are moved to a predetermined position is started;

a code to execute the second print job in priority to the stopped first print job if it is determined that the state in which the first print job is stopped has continued for the predetermined time; and a code to control not to determine that the state in which the first print job is stopped has continued for the predetermined time in a case where it is judged that the preparation operation is started before it is determined that the state in which the first print job is stopped has continued for the predetermined time.

* * * * *